US005671671A

United States Patent [19]

Wyssmann et al.

[11] Patent Number: 5,671,671

[45] Date of Patent: Sep. 30, 1997

[54] ROTARY SCREEN PRINTING MACHINE FOR SHEET PRINTING

[75] Inventors: Hans Wyssmann, Zurich, Switzerland; Johannes Georg Schaede, Wuerzburg, Germany

[73] Assignee: De La Rue Giori S.A., Switzerland

[21] Appl. No.: 588,131

[22] Filed: Jan. 18, 1996

[30] Foreign Application Priority Data

Jan. 24, 1995 [CH] Switzerland ..... 192/95

[51] Int. Cl.[6] ..... B41L 13/18

[52] U.S. Cl. ..... 101/120; 101/124

[58] Field of Search ..... 101/120, 119, 101/116, 117, 118, 124, 246; 118/213, 46

[56] References Cited

U.S. PATENT DOCUMENTS

| | | | |
|---|---|---|---|
| 4,911,069 | 3/1990 | Hayama et al. | 101/120 |
| 5,081,924 | 1/1992 | Ohinata | 101/120 |
| 5,483,878 | 1/1996 | Hanzawa | 101/118 |

FOREIGN PATENT DOCUMENTS

| | | | |
|---|---|---|---|
| A 0095 819 | 12/1983 | European Pat. Off. . | |
| A 0340 342 | 11/1989 | European Pat. Off. . | |
| A 0555 073 | 8/1993 | European Pat. Off. . | |
| A 3903 721 | 8/1989 | Germany . | |
| 178285 | 10/1984 | Japan | 101/116 |
| 49989 | 3/1985 | Japan | 101/120 |

*Primary Examiner*—Edgar S. Burr
*Assistant Examiner*—Daniel J. Colilla
*Attorney, Agent, or Firm*—Kane, Dalsimer, Sullivan, Kurucz, Levy, Eisele and Richard LLP

[57] ABSTRACT

The rotary screen printing machine has a form cylinder (1) which carries a screen printing stencil (3), and an impression cylinder (2) having at least one cylinder pit (4), in which sheet grippers (5) are installed. In their closing position, the sheet grippers (5) do not project above the printing surface of the impression cylinder (2). Arranged inside the form cylinder (1) is an adjustable doctor (6) which can be controlled by an actuating mechanism (7, 8, 9) in such a way that, during a printing operation, the doctor (6) is pressed against the inside of the screen printing stencil (3), but is lifted off from this screen printing stencil when the open region of a cylinder pit (4) of the impression cylinder (2) passes the form cylinder (1).

6 Claims, 5 Drawing Sheets

ROTARY SCREEN PRINTING MACHINE FOR SHEET PRINTING

FIELD OF THE INVENTION

The invention relates to a rotary screen printing machine for sheet printing.

PRIOR ART

In high-speed sheet-fed printing machines, the sheets are held on the impression cylinder by means of sheet grippers which are accommodated in cylinder pits of the impression cylinder.

Rotary screen printing machines work with a cylindrical, elastically flexible screen printing stencil which is stretched on the circumference of a form cylinder and which is stressed on the inside by a doctor which accumulates upstream of the printing nip the ink bead necessary for the printing operation. The problem here is that, during the passage of a cylinder pit of the impression cylinder, the screen printing stencil does not receive from this impression cylinder any support which can absorb the doctor pressure necessary for printing, so that the screen printing stencil is pressed into the cylinder pit and may thereby be damaged. Measures consequently have to be provided, such that, during the passage of a cylinder pit, the doctor pressure does not damage the screen printing stencil, and that the ink bead necessary for printing is at the same time preserved.

A rotary screen printing machine is known from D E-A-3,903,721. In this sheet-fed printing machine, the impression cylinder does not have any grippers; the sheets are fed to the printing nip by means of pairs of conveying rollers arranged in the vicinity of the printing nip. The form cylinder has a circumferential portion consisting of a netting material and has a screen printing stencil which is arranged above said circumferential portion and which is fastened to a rail extending along a generatrix of the form cylinder. The impression cylinder has a cylinder pit matched to this rail, so that, during the passage of the printing nip, this rail can penetrate this cylinder pit. Provided inside the form cylinder is a doctor roller which can be adjusted periodically in the radial direction and which bears against the inside of the netting material and therefore of the screen printing stencil. The distance between the axes of the form cylinder and of the impression cylinder is selected so that it is somewhat greater than the sum of the radius of the impression cylinder and the radius of the form cylinder in the event that the screen printing stencil of the latter assumes a position concentric relative to the cylinder axis. Consequently, as long as the screen printing stencil maintains its concentric position relative to the cylinder axis, the impression cylinder and the form cylinder are at a specific distance from one another which amounts to a multiple of the sheet thickness. During the printing operation, the inner doctor roller exerts a radially outward-directed pressure on the screen printing stencil, so that the latter is curved eccentrically outwards and the printing nip is thereby closed. The screen printing stencil of the form cylinder therefore constantly has to be deformed periodically outwards, thus impairing its service life and obviously limiting the printing speed which can be achieved.

SUMMARY OF THE INVENTION

The object on which the present invention is based is to provide a rotary screen printing machine, in which the sheets are transported and held in the conventional way by grippers of the impression cylinder, and in which, during the passage of a cylinder pit of the impression cylinder, the screen printing stencil is relieved of the pressure of the inner doctor, at the same time preserving its cylindrical shape.

In this way, by means of the screen printing machine according to the invention, the printing speeds customary during sheet printing can be achieved and any risk of damage to the screen printing stencil can be ruled out. Since only a very small adjustment travel is necessary in order to lift off the doctor from the screen printing stencil so as to relieve the latter of the doctor pressure, the ink bead necessary for printing is maintained virtually intact upstream of the printing nip. This guarantees that, when the doctor is lowered onto the screen printing stencil after the passage of a cylinder pit, the pressure can recommence after only a very short starting stage. Moreover, the adjusting mechanism for the doctor is distinguished by simplicity of construction.

When, in special instances, the print start is located very near to the sheet leading edge, it is advantageous to provide an adjustable partial covering of a cylinder pit of the impression cylinder and of the grippers located therein. Before the print start, this covering assumes its covering position, so that the doctor of the form cylinder can be lowered even shortly before the moment when the gripper edge passes the printing nip, since the doctor and the screen printing stencil receive support from this covering. By means of such a covering of the cylinder pit and of the grippers, therefore, the cylinder casing is completed in full in the direction of rotation of the cylinder, so that, in the region of the grippers, there are no holes or edges, on which the screen or the lowered doctor could be damaged.

BRIEF DESCRIPTION OF THE DRAWINGS

The invention is explained in more detail by means of exemplary embodiments with reference to the drawings. In these.

DESCRIPTION OF THE PREFERRED EMBODIMENTS

Figure 1A:
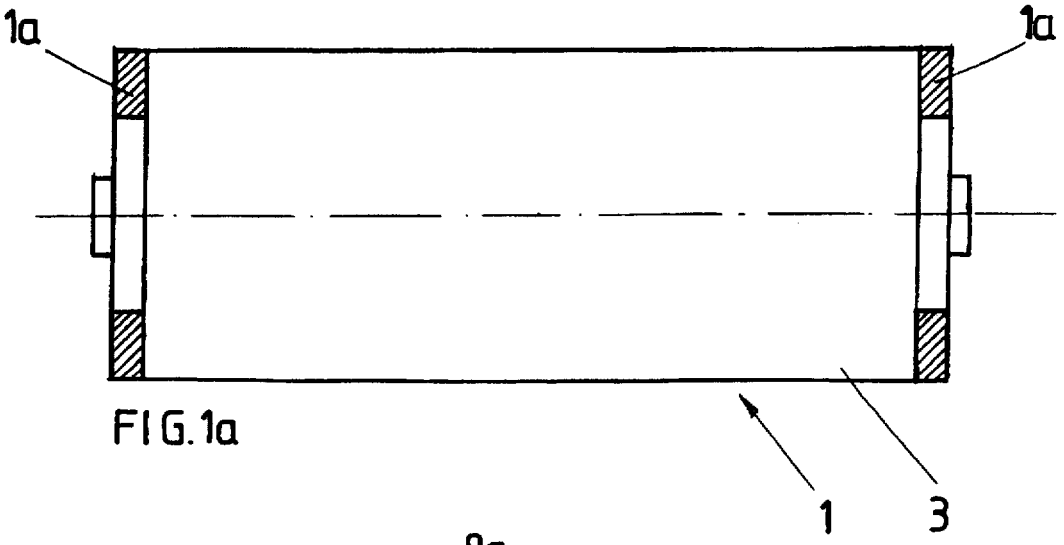
FIG. 1*a* shows the form cylinder with two lateral annular flanges to which is fastened the elastic printing stencil with the lateral control cams omitted for clarity.
Figure 1:
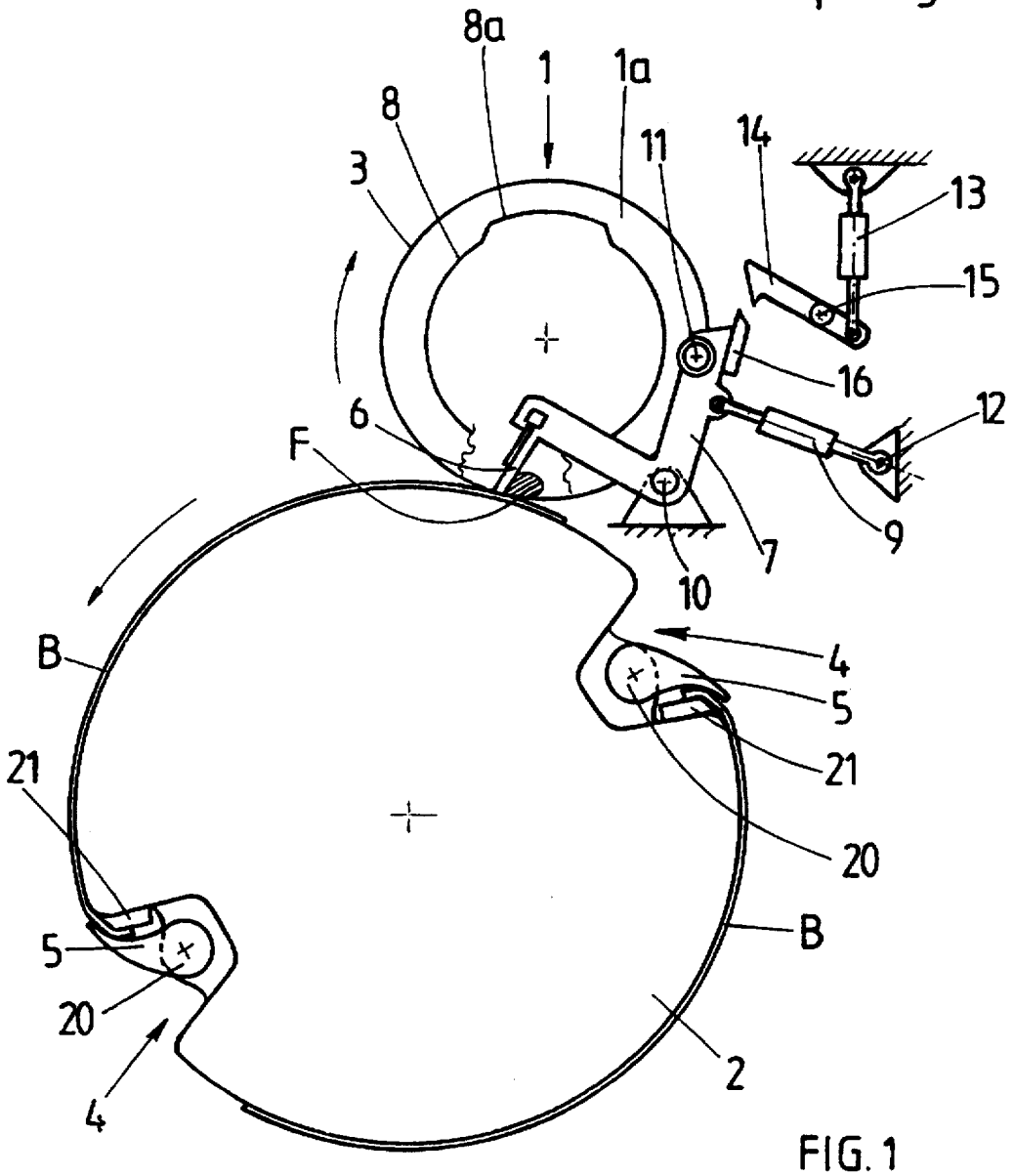
FIG. 1 shows the diagrammatic representation of an exemplary embodiment of a screen printing machine according to the invention, specifically during the printing of a sheet.
Figure 2:
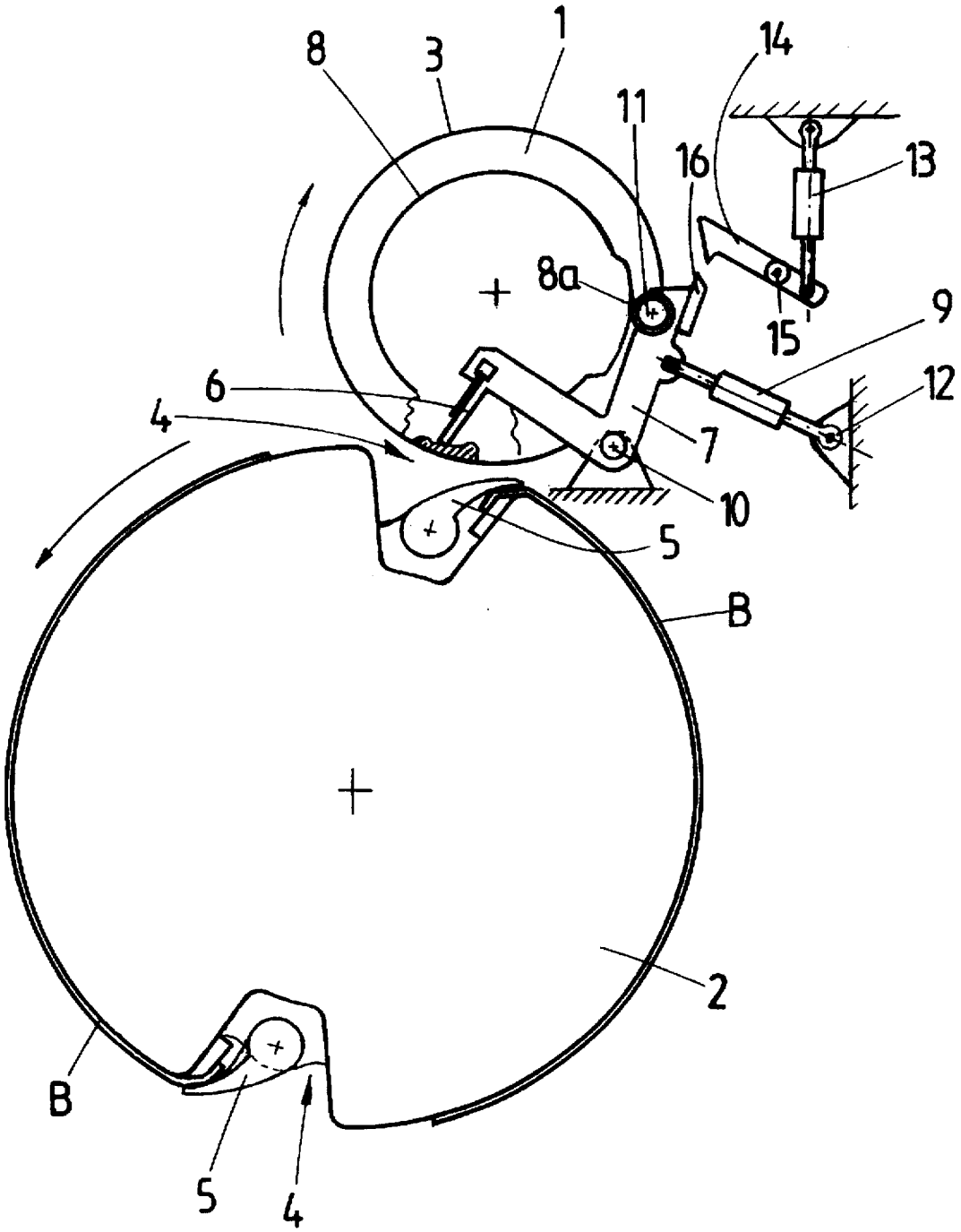
FIG. 2 shows the same machine in that position of the cylinders in which a cylinder pit of the impression cylinder is just passing the form cylinder.

According to FIGS. 1 and 2, the rotary screen printing machine has a form cylinder 1 and an impression cylinder 2 which, with the form cylinder, forms a printing nip which the sheets B pass for the purpose of being printed by the form cylinder 1. The directions of rotation of the cylinders are indicated by arrows. The casing of the form cylinder 1 consists solely of a cylindrical screen printing stencil 3 which lies concentrically relative to the cylinder axis and which is elastically flexible and is fastened to annular flanges 12 on both sides of the form cylinder 1 as shown in FIG. 1*a*.

In the exemplary embodiment under consideration, the diameter of the impression cylinder 2 is twice as large as that of the form cylinder 1. The impression cylinder 2 therefore has two printing segments which each receive a sheet B and which are separated by cylinder pits 4 located diametrically opposite one another. Accommodated in these cylinder pits 4 are the sheet grippers 5 which are mounted adjustably on gripper shafts 20 in the conventional way and which, with their gripper edge, hold the leading edge of a sheet B during its transport on the impression cylinder 2 and during the printing operation (FIG. 1) by pressure against the gripper rest 21. The grippers 5 are mounted in such a way that, in their closing position, they do not project above the printing surface of the impression cylinder 2.

Installed inside the form cylinder 1, in the region upstream of the printing nip, is a doctor 6 which, on the one hand, accumulates the ink inside the form cylinder 1 directly upstream of the printing nip to form an ink bead F and, on the other hand, serves, during the printing operation, for pressing the screen printing stencil 3 from inside against the impression cylinder 2, that is to say against the sheet B (FIG. 1) located on a printing zone of the impression cylinder 2. However, since, during the passage of a cylinder pit 4, the elastic screen printing stencil 3 does not receive from the impression cylinder 2 any support which can absorb the doctor pressure necessary for printing, and therefore the screen printing stencil would be destroyed by being pressed into the cylinder pit, during the passage of a cylinder pit 4 the doctor 6 is lifted off from the screen printing stencil 3 to such an extent that the doctor pressure does not damage the screen printing stencil, but the ink bead F necessary for printing is at the same time preserved.

For this purpose, the doctor 6 is controlled by an actuating mechanism which, in the example under consideration, has a lever 7 in the form of an angle lever, a control cam 8 rotating with the form cylinder 1 fixedly in terms of relative rotation and taking the form of a cam disk, and an actuating cylinder 9. The lever 7 is mounted pivotably about a fixed axis 10 in the middle, that is to say at its angle corner. The doctor 6 is fastened to that end of the lever 7 located inside the form cylinder 1, whilst the other end of the lever carries a cam roller 11 which cooperates with the control cam 8. The actuating cylinder 9 engages in the vicinity of that end of the lever 7 carrying the cam roller 11, said actuating cylinder being mounted pivotably about a fixed axis 12 and seeking to pivot the lever 7 with an adjustable force about the axis 10 anticlockwise according to FIG. 1, so that the doctor 6 is therefore pressed in the direction of the inside of the screen printing stencil 3. The control cam 8 has a radially outward-widened region 8*a*, the circumferential length of which is matched to the dimension of a cylinder pit 4. This region 8*a* of the control cam is so arranged in register with the cylinder pits 4 and its radius is dimensioned in such a way that, whenever a cylinder pit 4 of the impression cylinder 2 passes the form cylinder 1, the doctor 6 is pivoted inwards as a result of the rolling of the cam roller 11 on this region 8*a* and is thus lifted off and separated from the screen printing stencil 3 (FIG. 2). The screen printing stencil 3 consequently cannot be pressed into a cylinder pit 4 and damaged.

The radius of the remaining large circumferential portion of the control cam 8, outside the region 8*a*, has a small dimension, such that the doctor 6, under the effect of the actuating cylinder 9 pressing on the lever 7, presses the screen printing stencil with predetermined force against a sheet B (FIG. 1) located on a printing zone of the impression cylinder 2. During the printing operation, therefore, the doctor 6 is subjected only to the force of the actuating cylinder 9, and the lever 7 does not touch the control cam 8 with its cam roller 11. The adjustment of the doctor 6 into the position separated from the screen printing stencil by means of the control cam 8 takes place counter to the effect of the actuating cylinder 9 loaded with constant force.

In order as far as possible to preserve the ink bead F, necessary for printing, while the doctor 6 is being lifted off, the doctor is lifted off only slightly over a small stage which, for example, can typically be of the order of magnitude of 1 mm and which is sufficient to relieve the screen printing stencil of the doctor pressure. This guarantees that, when the doctor 6 is lowered onto the screen printing stencil 3 after the passage of a cylinder pit, the pressure can recommence after a very short starting stage and the ink bead is preserved virtually intact or is completed quickly again.

The measure described allows printing speeds which correspond to the speeds customary during sheet processing. It is consequently also possible to interlink the screen printing process directly with other printing processes, so that labor savings without losses of production are possible. Thus, in particular a screen printing machine according to the invention can be combined with another printing machine, for example a downstream numbering machine or a downstream offset printing machine, in such a way that the sheets leaving the screen printing machine are fed, without any interruptions, by a corresponding transport system, particularly a chain gripper system, directly to the following printing machine which can be operated at the customary printing speed.

In the example considered according to FIGS. 1 and 2, there is provided a further actuating mechanism with an actuating cylinder 13 and with a pawl lever 14 which is pivotable about a fixed axis 15 by the actuating cylinder 13 between two positions. In one position of the pawl lever 14, illustrated in FIGS. 1 and 2, the latter is separated from the lever 7 and has no influence on the functioning of this lever 7. In the other position, the pawl lever 14 is pivoted anti-clockwise in the representation according to the figures, until its pawl attached to the end engages behind that end of the lever 7 carrying the cam roller 11 and constantly blocks this lever 7 in an ineffective position, such that the doctor 6 is pivoted into the interior of the form cylinder 1 and is lifted off from the screen printing stencil 3. For this purpose, the lever 7 is provided with a stop 16, behind which the pawl of the pawl lever 14 engages in the last-mentioned position. The lever 7 is brought into this blocking position, with the doctor 6 lifted off, whenever the impression cylinder 2 is lifted off from the form cylinder 1 in the event of an interruption or at the end of printing operation.

In particular instances in which the print start commences very near to the sheet leading edge, it may happen that the lowering of the doctor onto the inside of the screen printing stencil takes place too late and therefore complete pressure does not occur. In order to avoid this, the impression cylinder can be equipped, in the region of its cylinder pit or of its cylinder pits, with an adjustable covering which covers the critical region of the cylinder pit at the print start above the closed sheet grippers and which both forms a cylindrical starting stage for the screen printing stencil during the printing process and affords space for the grippers. Such an embodiment of an impression cylinder is illustrated in FIGS. 3 and 4.

Provided in a cylinder pit 4 of the impression cylinder 2, in addition to the grippers 5 seated on the gripper shaft 20, is a pivotable lever arm 22, the inner end of which is pivotable about a shaft 23 installed in the vicinity of the pit bottom underneath the gripper shaft 20 in the impression cylinder 2 and the other end of which is provided with a flat covering 24. On the side facing the gripper shaft 20, the lever arm 22 has a recess 25 matched to this gripper shaft 20. The gripper mechanism, the gripper rest 21 and the grippers 5 resting there with their gripper edge 5*a* in their closing position are lowered below the envelope of the printing surface of the impression cylinder. The arrangement is such that the lever arm 22 is pivotable between a position (FIG. 4) lowered completely into the interior of the cylinder pit 4 and a position in which the covering 24 covers that region of the pit 4 occupied by the closed grippers 5, specifically in such a way that the cylindrical circumferential surface of that printing zone of the impression cylinder 2 located behind it, on which printing zone a sheet rests, is extended by the top side of the covering 24 as far as approximately the middle of the cylinder pit 4 (FIG. 3). This covering 24 is therefore designed in such a way that it affords space for the grippers 5 of the impression cylinder 2, covers these completely and forms a closed surface with the adjacent printing segment of the impression cylinder 2.

Figure 3:
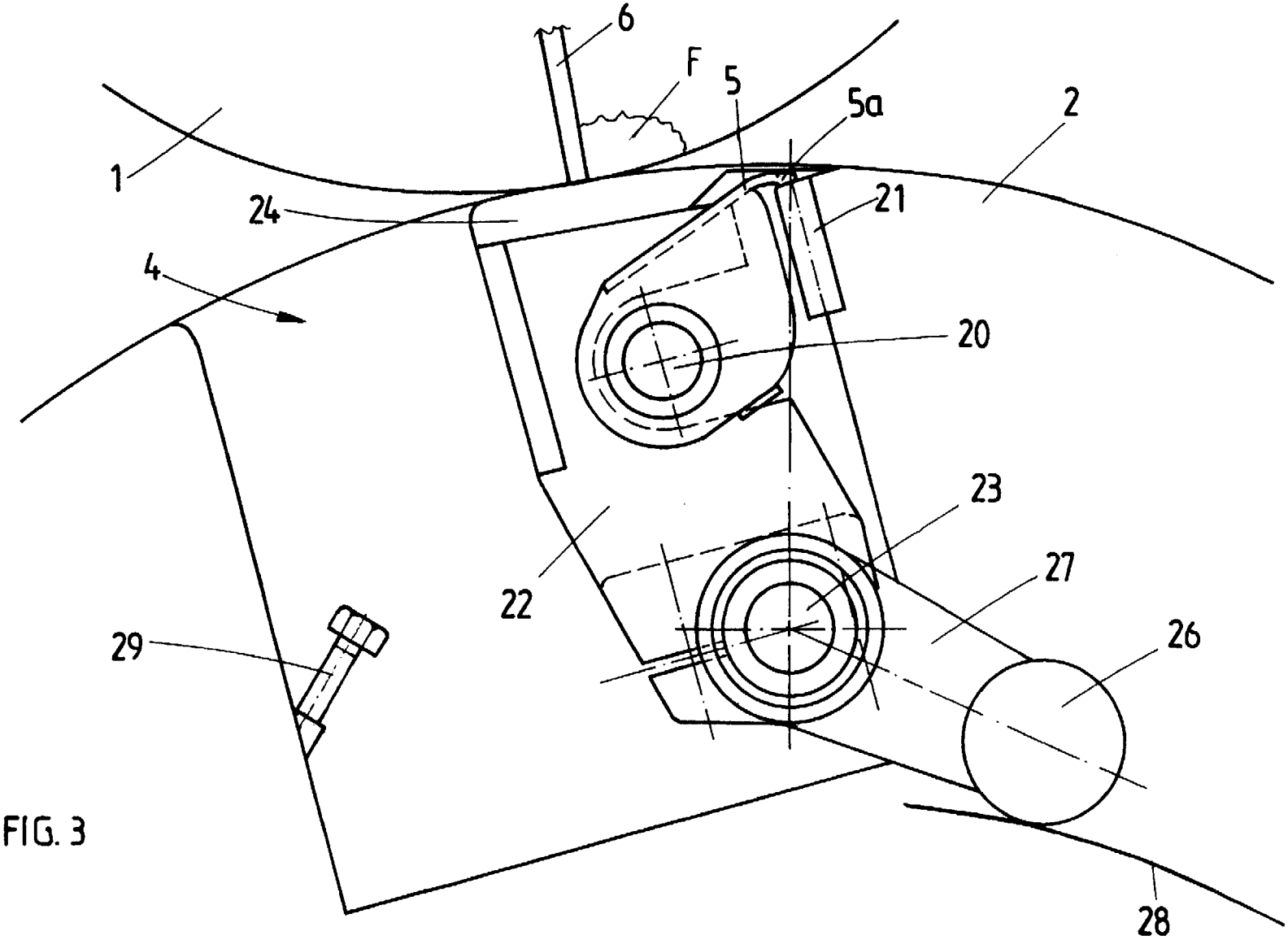
FIG. 3 shows, enlarged, the region of a cylinder pit of a specially designed impression cylinder of a second embodiment immediately before the start of a printing operation, with an adjustable covering of the cylinder pit which, in the representation according to FIG. 3, is partially covered.
Figure 4:
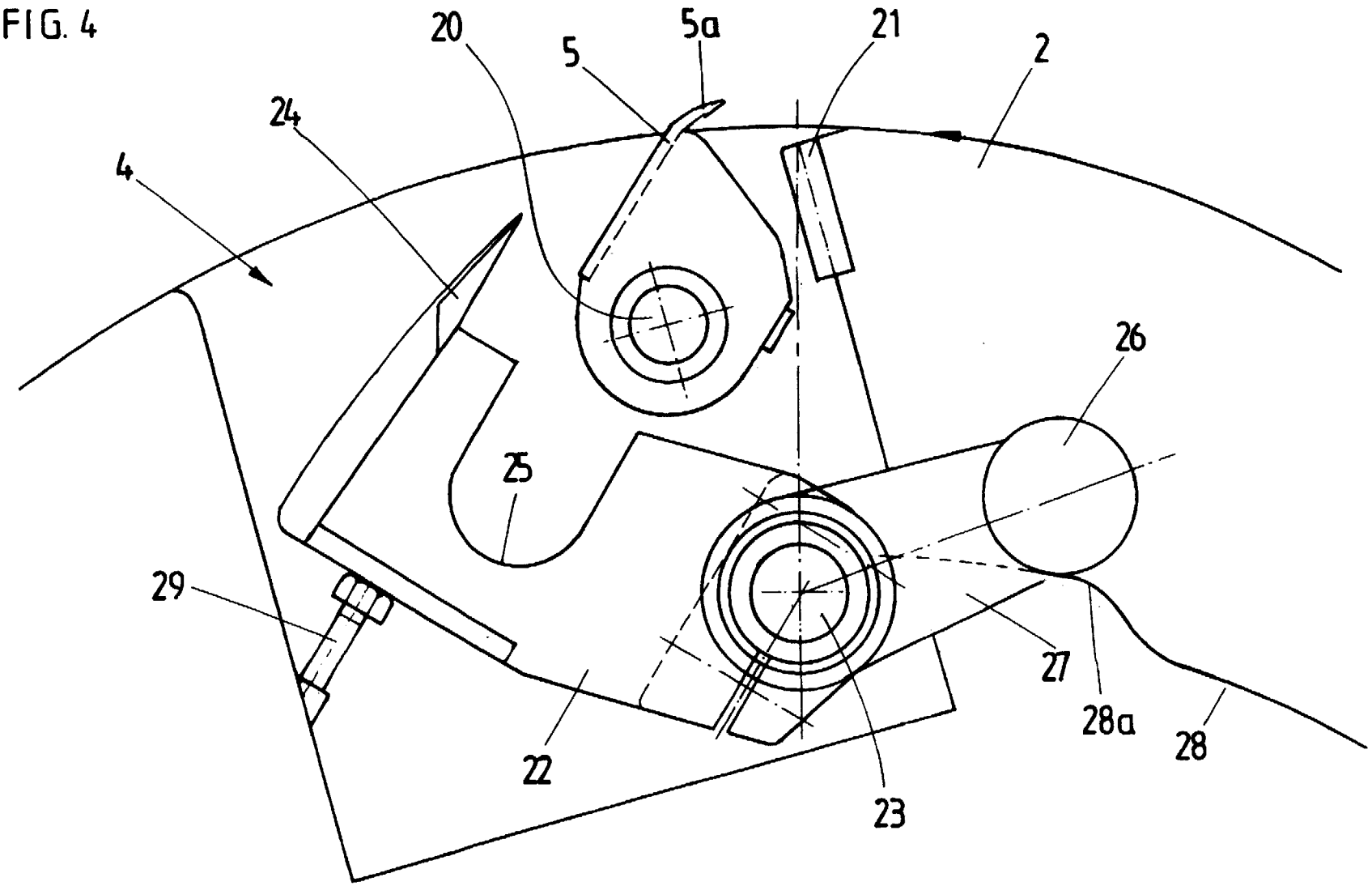
FIG. 4 shows the same arrangement as in FIG. 3, but the covering assuming its position of rest lowered into the interior of the cylinder pit.

As shown in FIG. 3, therefore, the cylinder pit 4 is partially covered in such a way that the doctor 6 in the form cylinder 1 can be lowered in front of the gripper edge 5*a* and nevertheless receives support, so that, on the one hand, correct printing is guaranteed and, on the other hand, the screen printing stencil is protected from damage. The covering 24 is therefore designed in such a way that it merges seamlessly into that printing segment of the impression cylinder 2 adjacent to the gripper edge and can cover the grippers 5 and the cylinder pit 4 with a starting curve over a sufficiently long starting stage matched to the screen printing process, on the diameter of the impression cylinder.

The control mechanism for the lever arm 22 together with its covering 24 consists, for example, of a conventional fixed cam disk or control cam 28 and of a cam roller 26 bearing and rolling thereon under prestress and mounted on the end of an arm 27 fastened to the lever arm 22. The control cam 28, which is indicated only diagrammatically in FIGS. 3 and 4, is designed in a similar way to the conventional control cam serving for opening and closing the grippers 5 and is shaped in such a way that, during the commencement of printing, the lever arm 22 together with the covering 24 assumes the closed position shown in FIG. 3. Before the grippers 5 are opened for transferring a sheet onto a transfer cylinder or receive a sheet from a transfer cylinder, the lever arm 22 together with the covering 24 is pivoted by the control cam 28 into the interior of the cylinder pit 4 into the position shown in FIG. 4, so that the countergrippers of the respective transfer cylinder can penetrate the cylinder pit of the impression cylinder 2. This position, in which the cam roller 26 rolls on the radially projecting region 28*a* of the control cam 28 and the lever arm 22 bears on a stop 29, is maintained until, after the further rotation of the impression cylinder 2, the grippers 5 have received a new sheet from the respective transfer cylinder and have assumed their closing position.

In the lowered position of the covering 24, therefore, the freely accessible space of the cylinder pit is sufficient to ensure that the countergrippers of the transfer cylinder feeding the sheet and of that discharging the sheet can penetrate the cylinder pit 4.

Thus, during a complete revolution of the impression cylinder 2, the following adjustments take place, starting from the printing position shown in FIG. 3:

After the cylinder pit has passed the form cylinder 1, the lever 22 together with the covering 24 is pivoted into the lowered position (FIG. 4) by the control cam 28, before the grippers 5 reach the transfer cylinder receiving the sheet; during the transfer of the sheet onto this transfer cylinder, the grippers 5 are adjusted into the opening position (FIG. 4), in which they remain until, after a corresponding further rotation of the impression cylinder 2, they reach the transfer cylinder feeding the sheets; the grippers 5 are then closed in order to hold the new sheet, and subsequently the lever arm 22 together with the covering 24 is adjusted again into the printing position shown in FIG. 3, before the sheet reaches the printing nip.

While the interruption formed between the front edge of the cylinder pit 4 and the closed covering 24 passes the form cylinder 1, the doctor 6 in the form cylinder 1 is pivoted inwards for the purpose of relieving the screen printing stencil 3; as soon as that region of the covering 24 at the front in the direction of rotation is located in the printing nip, the doctor 6 is lowered again onto the screen printing stencil 3, so that a stable ink bead can form up to the commencement of printing on the printing segment of the impression cylinder 2.

Figure 5:
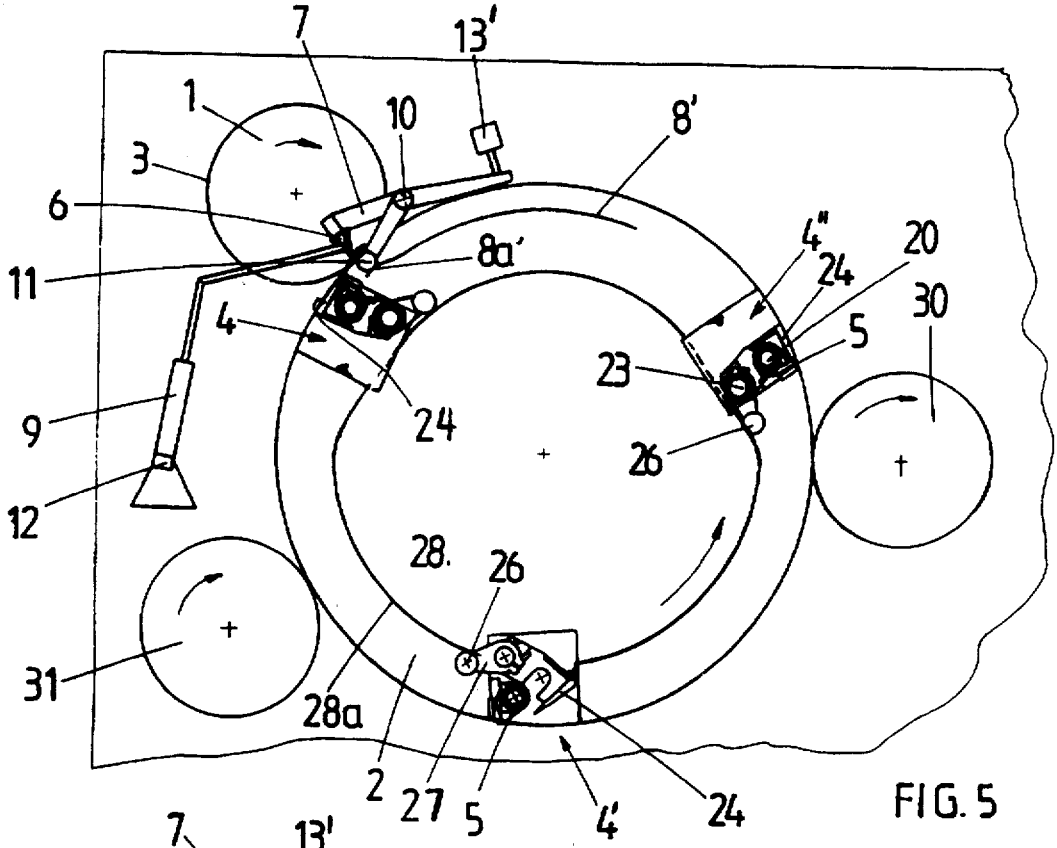
FIGS. 5 and 6 show a diagrammatically represented third embodiment of a screen printing machine in two different positions.
Figure 6:
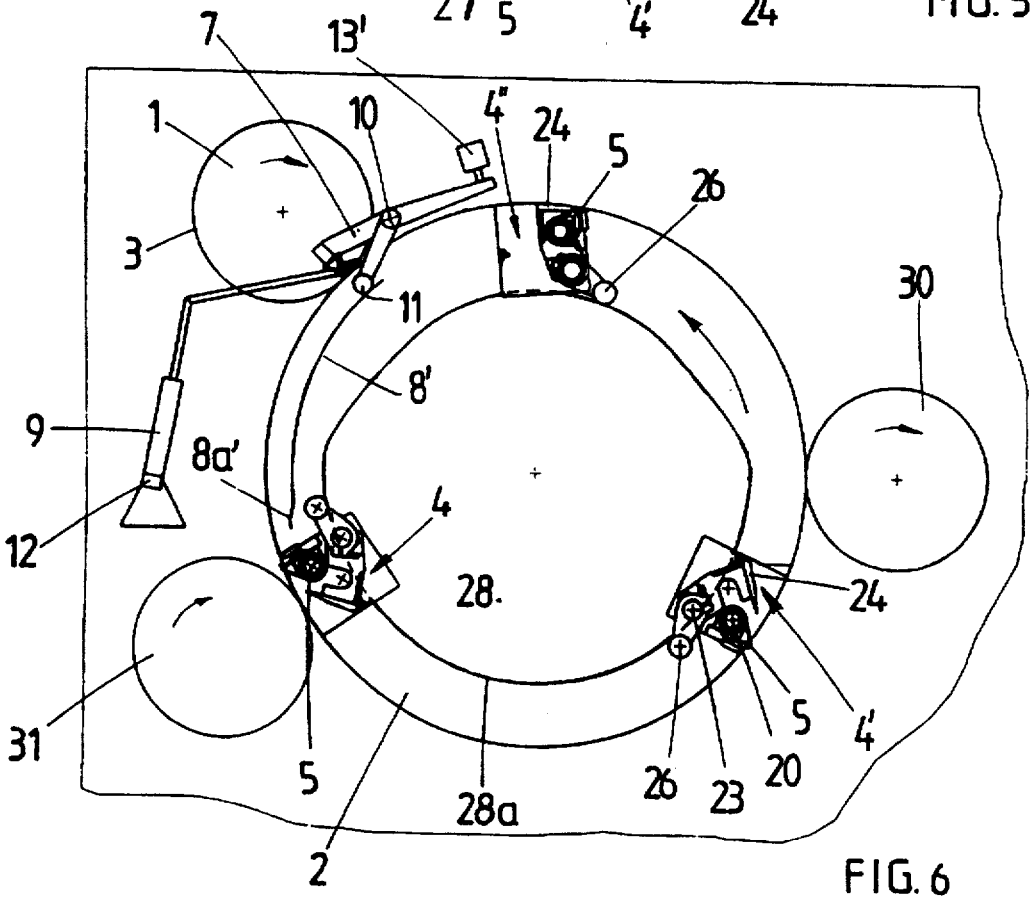

FIGS. 5 and 6 show diagrammatically a further embodiment of a screen printing machine according to the invention, in which, as described with reference to FIGS. 3 and 4, the cylinder pits are partially covered during the passage of the printing nip and the grippers are thereby covered completely in their closing position. In this example, the impression cylinder 2 has three printing segments separated by three cylinder pits 4, 4' and 4".

However, the main difference from the exemplary embodiment according to FIGS. 1 and 2 is that the control cam 8', which controls the lifting-off of the doctor 6 from the inside of the screen printing stencil 3 during the passage of a cylinder pit 4, is fastened laterally to the impression cylinder 2 fixedly in terms of relative rotation and rotates together with this. As a result, advantageously the form cylinder is relieved of the weight of this control cam. In conformity with this design, the actuating mechanism for the doctor 6 is arranged differently, but consists essentially of the parts described with reference to FIGS. 1 and 2, namely of the lever 7 which carries the doctor 6, is pivotable about the fixed axis 10 and, moreover, is provided with the cam roller 11 which rolls on the control cam 8', furthermore of the actuating cylinder 9 which is mounted in an articulated manner at 12 and by which the doctor 6 is stressed with predeterminable force, and of the further actuating mechanism 13', indicated merely diagrammatically, which, like the parts 13, 14 and 15 according to FIGS. 1 and 2, allows the doctor 6 to be blocked in its lifted-off position. The control cam 8' has, in each of the regions of the three cylinder pits 4, 4', 4", a radially projecting zone 8*a*', by means of which the cam roller 11 together with the lever 7 is adjusted and thus, whenever the open region of a cylinder pit passes the printing nip, the doctor 6 is briefly lifted off from the screen printing stencil 3, as described with reference to FIGS. 1 and 2.

As in the example according to FIGS. 3 and 4, in each cylinder pit 4, 4', 4" are mounted sheet grippers 5 adjustable about a gripper shaft 20, a gripper rest and a covering 24 which is fastened to a lever arm 22; this lever arm 22 is pivotable about the shaft 23 and once again carries a cam roller 26 which bears and rolls on a fixed control cam 28 under mechanical prestress.

FIGS. 5 and 6 show diagrammatically a transfer cylinder 30 transferring the sheets onto the impression cylinder 2 and a transfer cylinder 31 removing the printed sheets from the impression cylinder 2. The arrangement is such that the covering 24, which assumes its closing position during the passage of the printing nip, is subsequently adjusted into its lowered position, before the transfer cylinder 31 is reached, and maintains said position until the other transfer cylinder 30 has been passed. Thereafter, before the printing nip is reached, the covering 24 is then closed once again. The control cam 28 accordingly has a radially outward-projecting zone 28*a* which includes the regions of the two transfer cylinders 30 and 31 and which ensures that, as long as a cam roller 26 rolls on this zone 28*a*, the respective covering 24 assumes its lowered open position. The grippers of the transfer cylinders 30 and 31 can therefore engage into the respective cylinder pits for the purpose of transferring a sheet to the open grippers 5 of the impression cylinder 2 or of receiving a sheet from the impression cylinder 2.

In the representation according to FIG. 5, the cylinder pit 4 has just passed the region of the printing nip and is still partially covered by the covering 24, whilst the covering 24 in the cylinder pit 4' is in the lowered position and the covering 24 in the cylinder pit 4 is in the closed position after passing the transfer cylinder 30. The doctor 6 still assumes its position lifted off from the screen printing stencil 3. In the representation according to FIG. 6, the impression cylinder 2 has been rotating somewhat further in the direction of the arrow, and the covering 24 of the cylinder pit 4, which is now passing the transfer cylinder 31, has in the meantime been lowered, whilst the position of the covering in the other two cylinder pits 4' and 4" has not changed; the doctor 6 once again assumes it position bearing on the screen printing stencil 3.

The invention is not restricted to the described exemplary embodiments of the actuating mechanism for the doctor 6 and of the actuating mechanism for the covering 24 of the impression cylinder 2, but permits a variety of constructive alternatives.

We claim:

1. A rotary screen printing machine for sheet printing, comprising a form cylinder (1) which carries a screen printing stencil (3), an impression cylinder (2) which has a cylindrical circumferential surface and at least one cylinder pit (4) and which forms a printing nip with the form cylinder (1), and a doctor (6) which can be adjusted radially inside the form cylinder (1) and which is installed in the region of the printing nip, wherein the impression cylinder (2) is provided, in each cylinder pit (4), with sheet grippers (5) which, in their closing position, do not project above the printing surface of the impression cylinder, and wherein the adjustable doctor (6) and an actuating mechanism (7, 8, 9) controlling said doctor being so constructed and arranged for pressing the doctor (6) against the inside of the screen printing stencil (3) during a printing operation, and for adjusting said doctor into a position of rest lifted off from the inside of the screen printing stencil (3) when the open region of the cylinder pit (4) of the impression cylinder (2) passes the region of the printing nip;

wherein a control cam (8, 8') is provided, the actuating mechanism having a pivotably mounted lever (7) having at least one end of which the doctor (6) being mounted and guided by the control cam (8, 8') rotating simultaneously with the form cylinder (1), and wherein the doctor (6) being pressed mechanically in the direction of the screen printing stencil (3), the form cylinder having a casing, and an axis, said casing consisting solely of the screen printing stencil (3), which is elastic and cylindrical and lies concentrically relative to the cylinder axis;

the control cam (8') being connected to the impression cylinder (2) fixedly in terms of relative rotation.

2. The screen printing machine as claimed in claim 1, wherein there is provided a further actuating mechanism (13, 14; 13') which is designed, during a rotation of the form cylinder (1), to hold said doctor (6) constantly in its position of rest lifted off from the screen printing stencil (3).

3. The screen printing machine as claimed in claim 1, wherein, in the position of rest, the doctor (6) is lifted off from the screen printing stencil (3) by an order of magnitude of only 1 mm.

4. A rotary screen printing machine for sheet printing, comprising a form cylinder (1) which carries a screen printing stencil (3) an impression cylinder (2) which has a cylindrical circumferential surface and at least one cylinder pit (4) and which forms a printing nip with the form cylinder (1), and a doctor (6) which can be adjusted radially inside the form cylinder (1) and which is installed in the region of the printing nip, wherein the impression cylinder (2) is provided, in each cylinder pit (4), with sheet grippers (5) which, in their closing position, do not project above the printing surface of the impression cylinder and wherein the adjustable doctor (6) and an actuating mechanism (7, 8, 9) controlling said doctor being so constructed and arranged for pressing the doctor (6) against the inside of the screen printing stencil (3) during a printing operation, and for adjusting said doctor into a position of rest lifted off from the inside of the screen printing stencil (3) when the open region of the cylinder pit (4) of the impression cylinder (2) passes the region of the printing nip;

each cylinder pit (4, 4', 4") of the impression cylinder (2) being covered partially by an adjustable covering (24) which, in the covering position, completely covers the closed sheet grippers (5) and which continuously extends that cylindrical circumferential surface of the impression cylinder (2) located in front of each cylinder pit in the cylinder direction of rotation, and wherein this covering (24) can be adjusted by means of an actuating mechanism (22, 26, 27, 28) between a covering position during the passage of the form cylinder (1) and a position lowered into the interior of the cylinder pit (4).

5. The screen printing machine as claimed in claim 4, wherein the actuating mechanism for the covering (24) has a fixed control cam (28).

6. The screen printing machine as claimed in claim 4, wherein the grippers have gripper edges (5*a*) and, during printing operation, even before the gripper edges (5*a*) holding the sheet arrive at the printing nip, the doctor (6) being so constructed and arranged to be pressed out of its position of rest against the screen printing stencil (3) which, at the same time, is supported by the covering (24).

* * * * *